United States Patent [19]

Haefliger

[11] 4,239,219

[45] Dec. 16, 1980

[54] PINBALL APPARATUS WITH REPLACEABLE MODULAR BARRIER SUPPORTS

[76] Inventor: Robert W. Haefliger, 1872 Alpine Dr., San Marino, Calif. 91108

[21] Appl. No.: 23,596

[22] Filed: Mar. 26, 1979

[51] Int. Cl.[2] ..... A63D 3/02

[52] U.S. Cl. ..... 273/121 A; 200/61.11; 273/127 R

[58] Field of Search ..... 273/6, 118 A, 119 A, 273/120 A, 121 A, 122 A, 127 R, DIG. 26; 272/3; 52/461, 476; 200/61.1, 61.11

[56] References Cited

U.S. PATENT DOCUMENTS

| | | | |
|---|---|---|---|
| 3,859,768 | 1/1975 | Donzis | 52/476 |
| 3,961,793 | 6/1976 | Zanders | 273/6 X |
| 4,109,911 | 8/1978 | Van Auken | 200/61.11 X |
| 4,171,807 | 10/1979 | Lamlee | 273/DIG. 26 X |
| 4,193,211 | 3/1980 | Dotsko | 35/12 N |

FOREIGN PATENT DOCUMENTS

| | | | |
|---|---|---|---|
| 106863 | 3/1939 | Australia | 52/461 |

*Primary Examiner*—Richard T. Stouffer
*Attorney, Agent, or Firm*—William W. Haefliger

[57] ABSTRACT

A pinball machine incorporates a ball playing field that may be varied, as by the user, for heightened interest in and attraction of the machine. The machine includes multiple deck elements removably carried by a support for the machine. These deck elements may be rearranged and replaced by substitutes. Different obstructions are typically carried by different deck elements so that a player or owner may rearrange the deck or play surface to change the playing field, and thereby alter the challenge of the game, at will.

7 Claims, 6 Drawing Figures

FIG. 2.
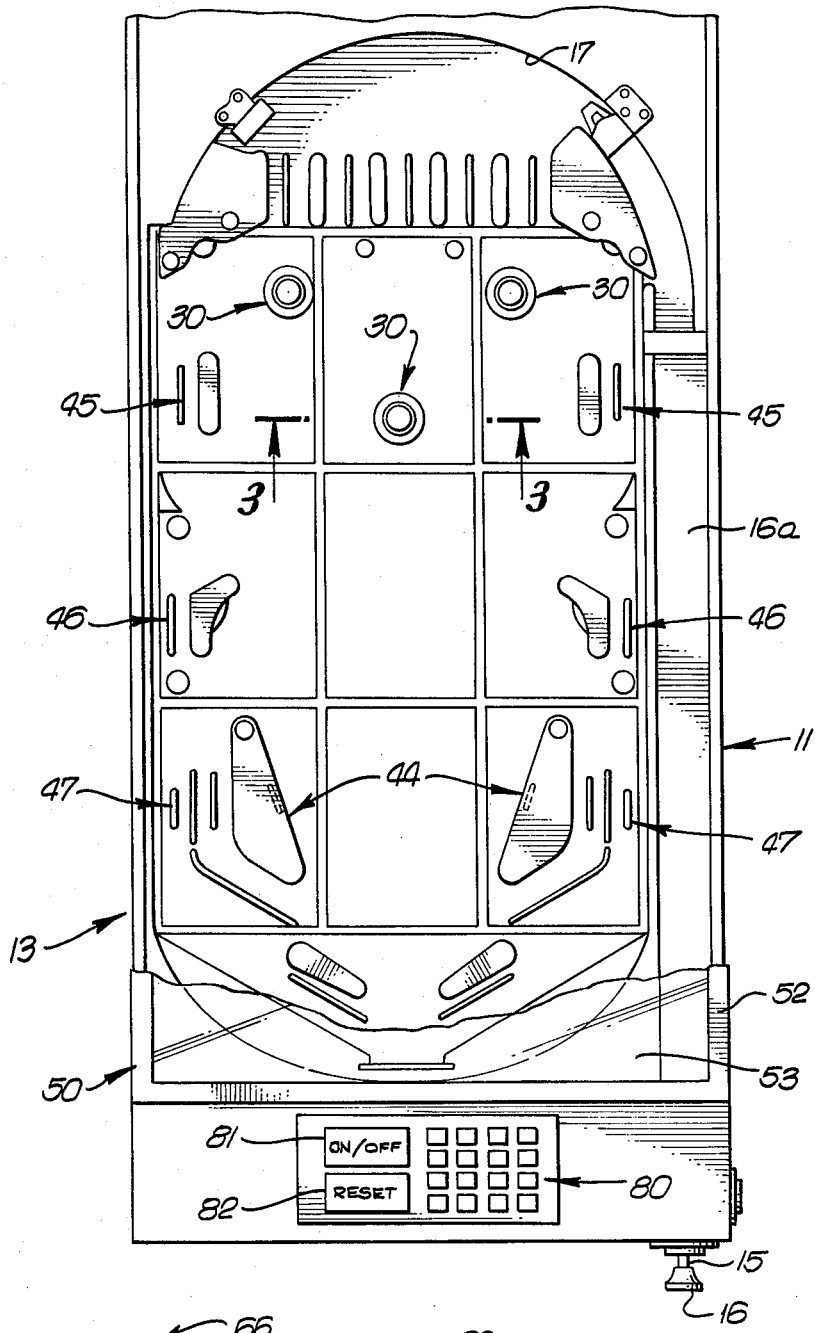
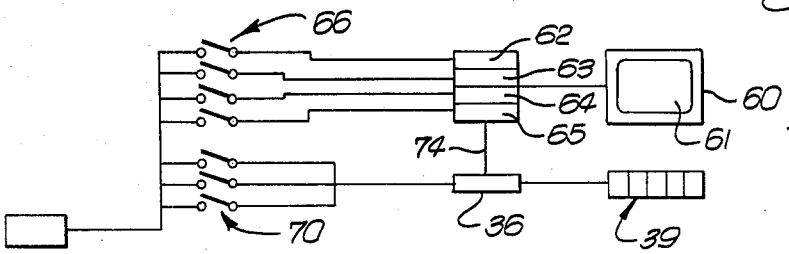
FIG. 6.

PINBALL APPARATUS WITH REPLACEABLE MODULAR BARRIER SUPPORTS

BACKGROUND OF THE INVENTION

This invention relates generally to pinball apparatus; more particularly it concerns apparatus which may be easily altered by a player or owner, to vary the challenge of the game.

Pinball machines, while popular, are inherently of fixed design, once built. A player with diligence can learn to maximize his score on a fixed design machine, after which the challenge offered by that machine is substantially reduced to that player. If he could vary the play-field, the challenge of the machine would not diminish, and more enjoyment would be realized. Also, the machine owner would benefit from extended use of the machine.

SUMMARY OF THE INVENTION

It is a major object of the invention to provide a new type pinball machine characterized as having an extended or extensible challenge in that the play-field may be readily altered. It is another object of the invention to provide a game selection format allowing the player to follow instructions called up on a CRT to rearrange the play-field and to play the "new" game created by the player.

The basic method and concept of the invention is embodied in a pinball type machine having an adjustable play-field traversed by a rolling ball, the steps including:

(a) providing a selectable instruction as to a game to be played, (b) creating a play-field in accordance with the selected instruction, and (c) playing the machine by causing the ball to traverse the created play-field.

As will be seen, the play-field may have one or more ball obstructions, some of which may be score producing, and the obstructions are re-arranged or replaced to create the "new" play-field; or, decks on which the obstructions are carried may be re-arranged or replaced.

The basic apparatus comprises:

(a) a support, (b) multiple deck elements removably carried by the support so as to provide upwardly exposed surfaces over which a ball is rollable, and (c) structure on at least one of the deck elements to be engaged by the rolling ball.

The support typically comprises a lattice-like framework into which deck elements or plates are selectively received to create a selected play-field; electrical connections associated with the deck plates may be made-up as decks are changed; and hold-down strips are typically releasably interfitted between the decks to cooperate with the decks and provide a common flush surface over which a ball is rollable.

These and other objects and advantages of the invention, as well as the details of illustrative embodiments, will be more fully understood from the following description and drawings, in which:

DRAWING DESCRIPTION

FIG. 2 is a top plan view of the machine of FIG. 1;

FIG. 6 is a circuit diagram.

DETAILED DESCRIPTION

Figure 1:
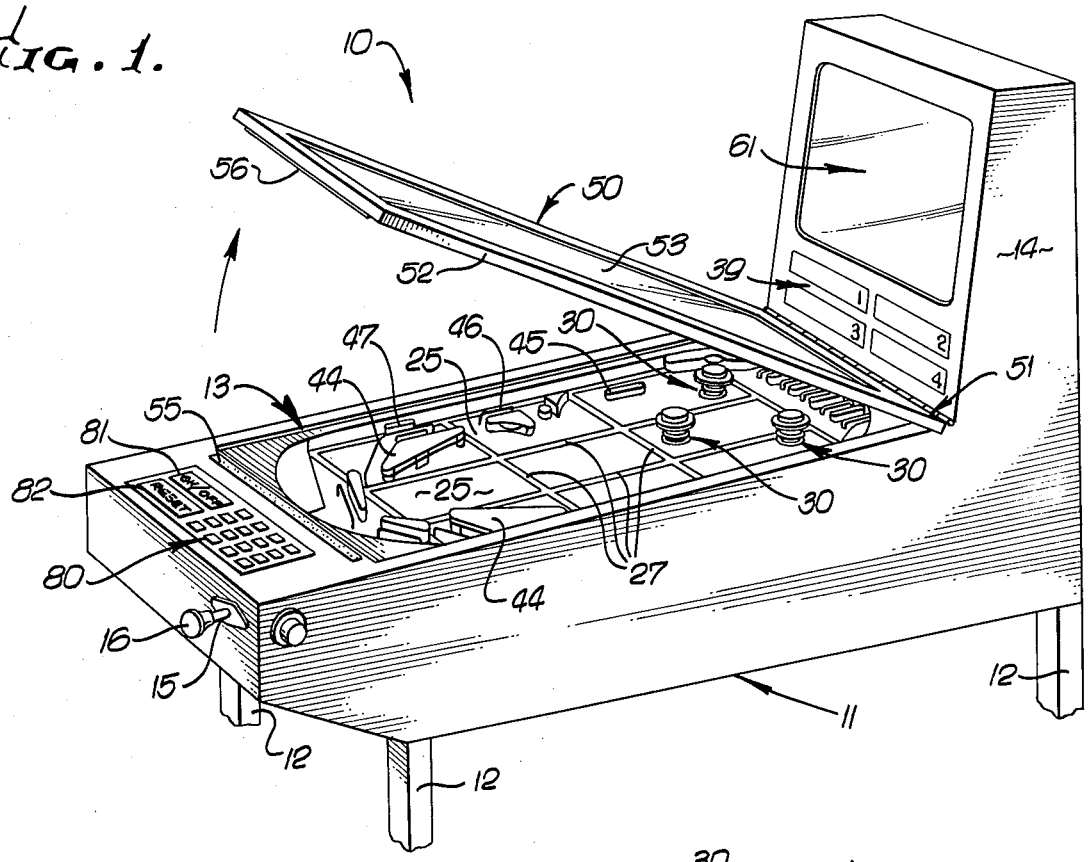
FIG. 1 is a perspective view of a pinball machine employing the invention.
Figure 3:
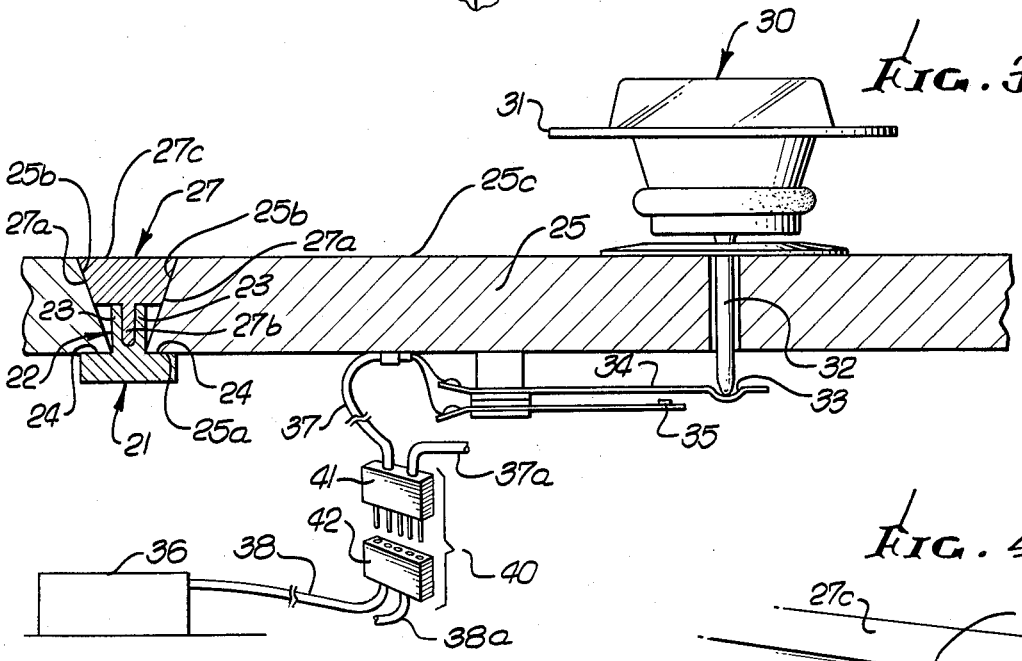
FIG. 3 is an enlarged vertical section taken through deck elements incorporated in FIG. 1.
Figure 4:
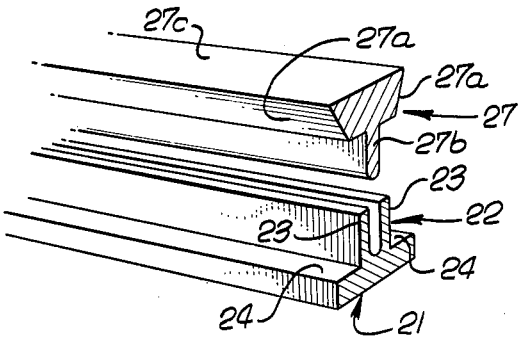
FIG. 4 is a perspective view of deck element retainer means.

In FIGS. 1 and 2, a pinball machine 10 includes a body 11 supported by legs 12, an inclined deck area 13 on top of the body, and an upright instruction and scoring results box 14 at the upper end of the machine. In playing the machine, a plunger 15 is retracted by a handle 16, and against a compression spring, as is conventional. When the plunger is released, it drives a ball upwardly along a chute 16*a*, there being a guide edge 17 that guides and turns the ball at the upper end of the deck area so that the ball may roll back down the deck area. As the ball rolls, it impacts against various obstructions some of which are resiliently deflectible and have associated switches which are activated when the ball strikes those particular obstructions. One of the latter, for example, is shown in FIG. 3, other types also being well known (see D. Gottlieb and Co., 1978 Parts Catalogue).

Figure 5:
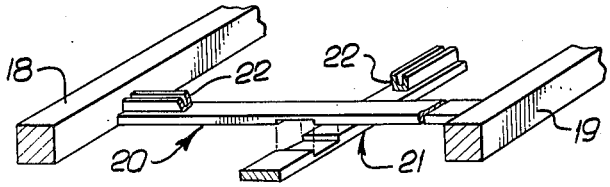
FIG. 5 is a perspective view showing the frame of the FIG. 1 machine.

In accordance with the invention, multiple deck elements are removably carried by a support or support structure associated with the body 11. FIG. 5 shows one such support as including side frame members 18 and 19 between which lateral support members 20 extend there being also longitudinal support members 21 which intersect the member 20 and form therewith a lattice-like support arrangement. The members 18–21 thereby form a support structure.

The members 20 and 21 may advantageously include upwardly projecting holders or parts 22 which may extend lengthwise of the members. Such holders may have U-shaped cross-sections, as best seen in FIG. 3, to define arms 23 which are sidewardly resiliently deflectible. Also, the members 20 and 21 define ledges 24 at opposite outer sides of the legs, and therebelow, to downwardly support lower edges 25*a* of the rectangular deck elements or plates 25. The side edges of the plates are beveled at 25*b*, so that a U-shaped notch is formed between facing beveled edges of adjacent deck plates. Into that notch is removably received an elongated retainer strip 27 with tapered edges 27*a* that overlie and engage the beveled edges 25*b* of the plates, thereby to removably attach the plates to the support 21. For this purpose, the retainers 27 have downwardly extending fasteners 27*b* attaching to the holders 22. The fastener may for example closely and frictionally fit between the arms 23, to hold the strips down against the deck elements, holding them down against the ledges 24. The tops 27*c* of the strips, and the tops 25*c* of the decks elements, are flush to define a flat deck surface on which the ball may roll, without impediment. A framework of the strips 27 and deck elements 25 therebetween, appears in FIG. 1. The deck elements may be considered as like-sized or modular.

Accordingly, it is clear that the like-sized deck elements may be rearranged, or replaced by substitutes, at the will of the player. This becomes important when it is realized that different obstructions are typically carried by different deck elements, so that the player or owner may rearrange his deck or play surface to change the play-field, and thereby alter the challenge of the game, at will.

The obstruction 30 shown in FIG. 3 comprises an upright post having a rim flange 31 to be struck by a ball rolling on surface 25*c*. The post then tilts, resiliently, to tilt the depending pin 32 laterally. The bottom of that pin rides in a cup 33 on switch arm 34, and when the pin 32 tilts, the arm 34 is deflected downwardly to close against contact 35. This closes a circuit at 36, via leads 37 and 38, to actuate a counter and increase the score of the player, appearing for example at display 39, seen in FIG. 1. A releasable electrical connection 40 in FIG. 3 connects leads 37 and 38, and includes housings 41 and 42, for multiple plugs and receptacles as shown. Other leads are indicated at 37*a* and 38*a*, lead 37*a* associated with the switch of another obstruction on the same deck that mounts obstruction 30. Thus, when the player changes decks, he merely establishes new connections at 40. Other switch actuating obstructions are indicated at 44–47, and may take the form as described in the 1978 Parts Catalogue of D. Gottlieb and Co., Northlake, Ill.

A cover for a deck area as shown at 50, and is hinged to the box at location 51. It typically includes a peripheral frame 52 for a glass plate 53. Retention of the rearward edge portion 54 of the cover to the recessed top portion of the box may be provided by detent means, or VELCRO strips, as at loci 55 and 56.

The upright box 14 is shown to contain a cathode ray tube 60 (see 60 in FIG. 6, also), with a screen 61 facing the player. Displayed on the screen are game instructions. FIG. 6 shows that programs are stored in the circuitry, as at 62–65. The player chooses the game he desires by pressing one appropriate switch, one for each program. Such switches are shown at 66. When he does this, the game instruction appear on the screen. Associated with each such game is a particular arrangement of decks 25, which the player may employ, as described above. Thus, the instructions on the CRT could instruct the player how to rearrange the decks, for the selected type game. Alternatively, the selection of the decks in a particular arrangement determines the game instructions appearing on the screen.

The switches associated with the obstructions appear at 70 in FIG. 6; the counter is at 36, and the score display at 39. If desired, the selected program may influence the counter, as via lead 74 in FIG. 6. Thus, for example a selected program may cause the counter to double count, for each closure of a particular one of the switches 70.

FIG. 1 shows a bank 80 of keys, which may be associated with respective switches 60 in FIG. 6. ON-OFF, and reset buttons appear at 81 and 82.

I claim:

1. In a pinball type machine, the combination comprising (a) a support, (b) multiple deck elements and elongated retainers removably carried by the support so as to provide upwardly exposed surfaces over which a ball is rollable, and (c) separate structures respectively carried on multiple of the deck elements to be engaged by the rolling ball, (d) said support comprising a lattice like framework defining upward openings sized to receive and interfit with said deck elements, (e) each said structure including a part projecting upwardly of a deck element and deflectible by the ball rolling on the upwardly exposed surface of said deck element, and an electrical switch located entirely beneath the deck element, said part operatively connected to the switch such that the switch is operated in response to deflection of said part, there being counter circuitry connected with said switch via a releasable electrical connection which is established in conjunction with placing the deck element onto the support, (f) each such part confined by the vertical boundaries of a single one of said deck elements and being entirely free of connection to others of said parts above said deck elements.

2. The combination of claim 1 wherein said deck elements are rectangular and extend in a common plane when carried by the support.

3. The combination of claim 1 wherein said retainers include elongated strips overlapping edge portions of the deck elements, the strips having upper surfaces which are flush with said deck element surfaces.

4. The combination of claim 3 including fasteners attaching the strips to the support below the levels of said upper surfaces.

5. The combination of claim 1 wherein said part is carried by the deck element to pivot relative thereto in response to ball contact therewith, and including spring means operatively connected to said part to yieldably resist said pivoting.

6. The combination of claim 1 including an instruction display on the support, and means to vary the instruction presented by the display in accordance with various arrangements of said deck elements.

7. The combination of claim 6 including a score display associated with said instruction display, the score display operatively connected with said structure to increase the displayed score as a function of ball impacts on said structures.

* * * * *